United States Patent [19]

Uchida

[11] 4,362,112

[45] Dec. 7, 1982

[54] DISCHARGE SIDE INDICATOR DEVICE FOR CASH DISCHARGE APPARATUS

[75] Inventor: Shinya Uchida, Tokyo, Japan

[73] Assignee: Laurel Bank Machine Co., Ltd., Tokyo, Japan

[21] Appl. No.: 227,778

[22] Filed: Jan. 23, 1981

Related U.S. Application Data

[63] Continuation-in-part of Ser. No. 40,965, May 21, 1979, abandoned.

[30] Foreign Application Priority Data

May 23, 1978 [JP] Japan ..... 53/61817

[51] Int. Cl.[3] ..... E05G 7/00

[52] U.S. Cl. ..... 109/19

[58] Field of Search ..... 109/12, 17, 19; 194/1 A; 312/223, 200; 221/195

[56] References Cited

U.S. PATENT DOCUMENTS 3,760,158 9/1973 Whitehead et al. .

4,066,253 1/1978 Lundbald et al. .

4,226,253 8/1980 Kokubo et al. .

*Primary Examiner*—Stanley H. Tollberg

*Attorney, Agent, or Firm*—Fleit & Jacobson

[57] ABSTRACT

Herein disclosed is a discharge side indicator device for use with a cash discharge apparatus. The cash discharge apparatus comprises a bill discharge machine and a coin discharge machine located thereon. The discharge side indicator device includes two pairs of indicator plates of sector shape, one of which is disposed on the bill discharge machine, and the other of which is disposed on the coin discharge machine. The indicator plates are located on the opposite sides of the bill discharge machine and the coin discharge machine so that they may be moved into and out of the body of the machines. A driving mechanism is used to alternately drive the indicator plates, when energized, so that they may be rotated so as to be protruded or retracted from the front face of the money discharge exits. This driving mechanism is electrically controlled by a suitable control system. Thus, an operator is made aware that it is permissible to remove money only from the side at which the indicator plate is retracted.

2 Claims, 4 Drawing Figures

DISCHARGE SIDE INDICATOR DEVICE FOR CASH DISCHARGE APPARATUS

This application is a continuation-in-part of U.S. application Ser. No. 40,965 filed May 21, 1979 now abandoned.

BACKGROUND OF THE INVENTION

The present invention relates to a discharge side indicator device for use with a cash discharge apparatus.

SUMMARY OF THE INVENTION

One object of the present invention is to provide a discharge side indicator device for use with a cash discharge apparatus, which is installed between two clerks seated at adjacent desks in a bank or the like, so that each of the clerks can carry out his cash discharge operations in an efficient and convenient manner without danger of the other clerk erroneously taking out the discharged money.

According to the present invention, there is provided a discharge side indicator device for use with a cash discharge apparatus which comprises a bill discharge machine and a coin discharge machine located thereon, comprising two pairs of indicator plates, one pair of which is disposed on the bill discharge machine at the opposite sides of the money discharge exit thereof, and the other pair of which is disposed on the coin discharge machine at the opposite sides of the money discharge exit thereof, said indicator plates being movable into and out of the body of said bill discharge machine and coin discharge machine, drive means energizable for driving only the indicator plates on one side to cause them to be protruded forwardly from the sides of said money discharge exits, and control means for controlling the energization of said drive means, whereby an indication is given that it is permissible to take cash out from only the side of said money discharge exits opposite to the side on which said indicator plates are protruded.

BRIEF DESCRIPTION OF THE DRAWINGS

Other objects and advantages of the present invention will become apparent from the following description taken in conjunction with the accompaning drawings, in which.

DESCRIPTION OF THE PREFERRED EMBODIMENT

The present invention will now be described in connection with the preferred embodiment thereof with reference to the accompanying drawings.

Figure 1:
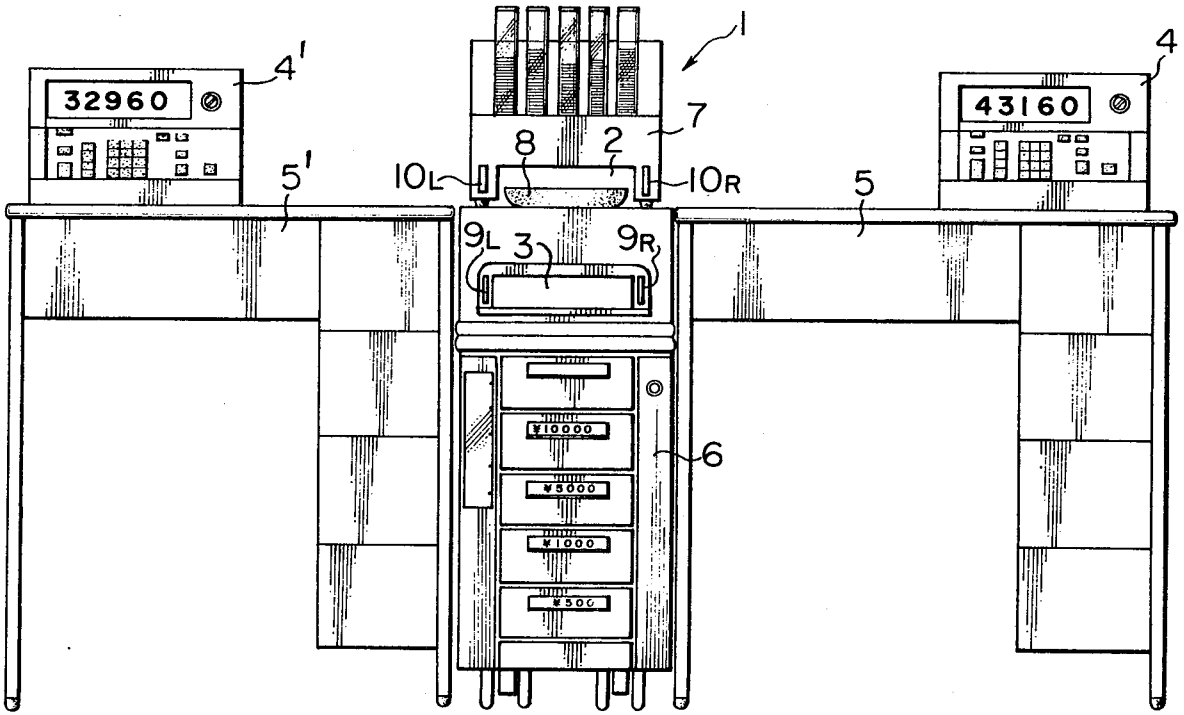
FIG. 1 is a front view showing a discharge side indicator device for use with a cash discharge apparatus according to the present invention.

Referring first to FIG. 1 showing a front view of a discharge side indicator device for a cash discharge apparatus according to the present invention, a cash discharge apparatus 1 is interposed between the right and left desks 5 and 5'. The cash discharge apparatus 1 generally comprises a bill or bank note discharge machine 6 and a coin discharge machine 7 located thereon. The bill discharge machine 6 is provided at the upper portion thereof with a money discharge exit 3 from which the bills discharged into the money discharge exit are taken out by the clerk. Provided at the opposite sides of the money discharge exit 3 are vertical slits 9R and 9L in which indicator plates, hereinafter described in more detail, are disposed. The coin discharge machine 7 is provided at the lower portion thereof with a money discharge exit 2 from which the coins discharged into a carton 8 are taken out by the clerk. The carton 8 is removably disposed on the upper surface of the body of the bill discharge machine 6 so as to receive the coins therein from the inside of the coin discharge machine 7. Also provided at the opposite sides of the money discharge exit 2 are slits 10R and 10L in which indicator plates are disposed.

There are mounted on the desks 5 and 5' a pair of control consoles 4 and 4', respectively, which can be operated by the clerks at the desks 5 and 5' to cause bills to be discharged into the money discharge exit 3 of the bill discharge machine from the inside thereof and coins to be discharged into the carton 8 located in the money discharge exit 2 of the coin discharge machine from the inside thereof.

The construction and function of the bill discharge machine and the coin discharge machine are similar to those of the prior art and therefore, a detailed explanation thereof is omitted herein. As such prior art, there are a coin counting and discharge machine of the type described in U.S. Pat. No. 4,226,253, and a cash dispensing apparatus of the type described in U.S. Pat. No. 3,760,158, issued Sept. 18, 1973, or a banknote dispensing apparatus of the type described in U.S. Pat. No. 4,066,253, issued Jan. 3, 1978.

Figure 2:
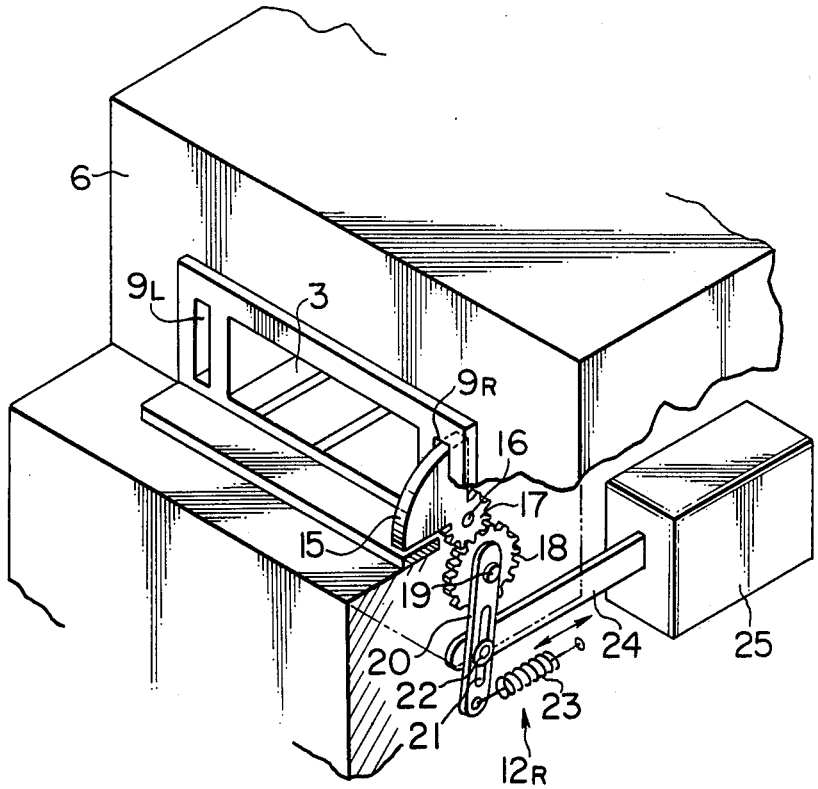
FIG. 2 is an enlarged perspective view showing a portion of the bill discharge machine of the cash discharge apparatus.

Turning now to FIG. 2 showing a portion of the bill discharge machine, an indicator generally indicatedby 12R is shown, which is provided at the right side of the bill discharge machine associated with the slit 9R thereof. Although another indicator is provided at the left side of the bill discharge machine associated with slit 9L, since this indicator is similar to the indicator 12R, a detailed description thereof is omitted herein. Furthermore, another pair of indicators is also provided on the coin discharge machine associated with the slits 10R and 10L. Since these indicators are also similar to the indicator 12R, a detailed description thereof is also omitted herein.

The indicator 12R includes an indicator plate 15 of a sector shape. The indicator plate 15 is rotatably mounted about a pivot pin 16 and is formed with a gear 17 which is engaged with a gear 18. The gear 18 is rotatably mounted about a pivot pin 19 and has a lever 20 rigidly secured thereon. The lever 20 is formed with a longitudinal slot 21 in which a slide pin 22 mounted on an actuator 24 of a solenoid 25 is slidably fitted. A spring 23 is provided for biasing the lever 20 in the anticlockwise direction. As a result, when the solenoid 25 is energized, the indicator plate 15 is rotated so as to be protruded from the inside of the slit 10R or from beside the front face of the money discharge exit 3 through the actuator 24, the lever 20, and the gear 18. When the solenoid 25 is deenergized, the indicator plate is rotated so as to be retracted into the slit 10R.

The protrusion of the indicator plate 15 provided at the right side of the bill discharge machine or the coin discharge machine makes the clerk seated at the right desk aware that he is not allowed to take out the cash and may obstruct his doing so.

Further, the bill discharge machine or the coin discharge machine need not be formed with the slits.

Figure 3:
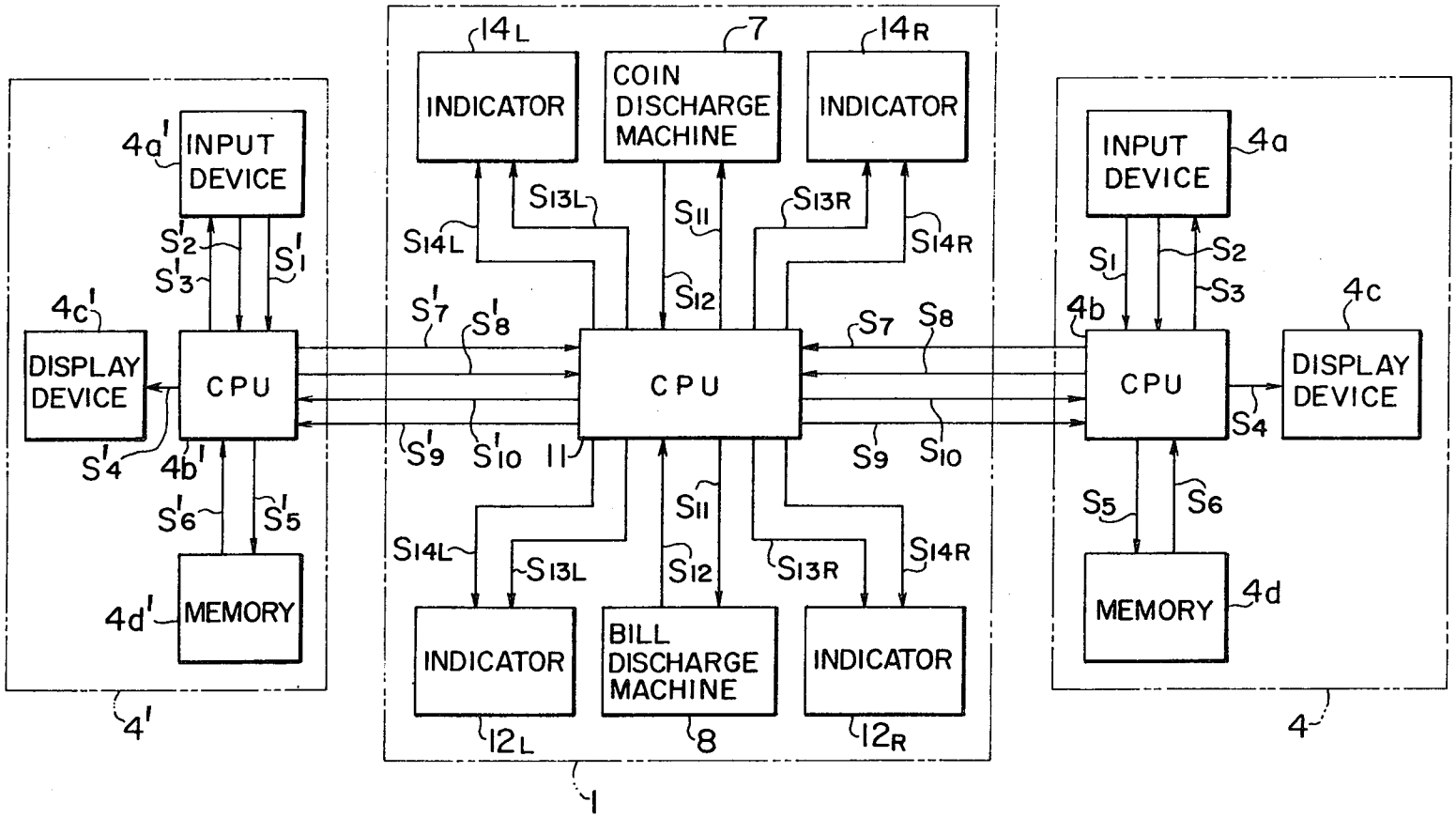
FIG. 3 is a block diagram showing a control system for use with the discharge side indicator device of the present invention.

Referring now to FIG. 3 showing a block diagram of a control system for use with the discharge side indicator device of the present invention, there are shown the block elements of the control consoles 4 and 4', and the cash discharge apparatus 1. Since the control system of the control console 4 and 4' are substantially identical, the block elements and the associated signals therebetween of the control console 4' at the left side are indicated by numerals which are the same as these of control console 4 at the right side, but having primes. For clarity, only one control console 4 will be explained.

The control console 4 comprises a control processing unit (CPU) 4*b*, an input device 4*a* having a keyboard through which data required for payment of cash are fed into the input device 4*a*, a display device 4*c* and a memory 4*d*. From the input device 4*a*, a data signal $S_1$ for the kinds of coins and bills and the amount of money to be discharged in put out so as to be received by the CPU 4*b*, and a discharge demand signal $S_2$ is put out to be received by the CPU 4*b* by operation of a discharge key. After the operation of the discharge key, an interlock signal $S_3$ for interlocking the operations of the input device 4*a* until the cash is taken out of the exits is issued from the CPU to be put in the input device in order to prevent malfunctions.

Put in the display device 4*c* is a data signal $S_4$ including data on the amount of money put in the CPU 4*b* from the input device 4*a*, data on the total amount of money to be paid calculated in the CPU 4*b* after the operation of the discharge key, etc. In accordance with the data signal $S_4$, the display device 4*c* displays the amount of money, the total amount of money to be paid, etc.

Put in the memory 4*d* is a data signal $S_5$ including data on the amount of money put in the CPU 4*b* from the input device 4*a*, data on the total amount of money to be paid calculated in the CPU 4*b*, number data on the numbers of coins and bills corresponding to the amount of money to be paid calculated in the CPU 4*b*, etc, and these data are stored in the memory 4*d*. Further, these data are fed out from the memory 4*d* as a data signal $S_6$ and put in the CPU 4*b* to be subjected to a calculation such as number conversion, that is, a conversion of the amount of money into numbers of coins and bills.

In accordance with a predetermined program, the CPU 4*b* processes the data signal $S_1$ from the input device 4*a*, puts out the interlock signal $S_3$ by the discharge demand signal $S_2$ and enters into communication with a control processing unit (CPU) 11 provided in the cash discharge apparatus 1 by means of signals $S_7$, $S_8$, $S_9$ and $S_{10}$, which will be described hereinafter in detail.

When a discharge request signal $S_7$ is fed from the CPU 4*b* into the CPU 11 and a request permission signal $S_9$ is put out from the CPU 11 into the CPU 4*b*, a discharge data signal $S_8$ for the kinds and numbers of coins and bills is issued from the CPU 4*b* to the CPU 11. The CPU 11 is permitted to receive the data signal $S_9$ in response to a request, that is, a discharge request signal $S_7$ or $S_7'$ from either one of two control consoles 4 and 4' and then puts out discharge signals $S_{11}$ on the basis of the discharge data included in the discharge data signal $S_8$ into the bill discharge machine 8 and the coin discharge machine 7, respectively. A series of count data signals 12 are sequentially issued from the bill discharge machine 8 and the coin discharge machine 7 to the CPU 11. When the count data thus received in the CPU 11 become equal to the discharge data stored in the CPU 11, the issuance of the discharge signals $S_9$ is inhibited. After it is confirmed that no malfunction has occurred, the bills and the coins accommodated in the bodies of the bill discharge machine and coin discharge machine are transferred to the money discharge exits thereof.

In the meanwhile, the CPU 11 issues drive signals $S_{13R}$ or $S_{13L}$ for driving indicators 12R, 14R or 12L, 14L provided opposite the side at which the request permission signal $S_9$ or $S_9'$ is issued. For example, provided that the request permission signal $S_9$ is issued from the CPU 11 to the control console 4 at the right side, the signals $S_{13L}$ for driving the indicators 12L and 14L provided at the left side are issued, and vice versa.

Further, provided on the money discharge exits are sensors for detecting the removed of the bills or coins (not shown) through which the CPU 11 issues reset signals $S_{14R}$ or $S_{14L}$ to cause the protruded indicators to return to their initial retracted positions after confirmation that the discharged cash has been taken out is made. Simultaneously, the CPU 11 transmits a payment end signal $S_{10}$ to the CPU 4*b* to allow the output of interlock signal $S_3$ to be stopped.

Figure 4:
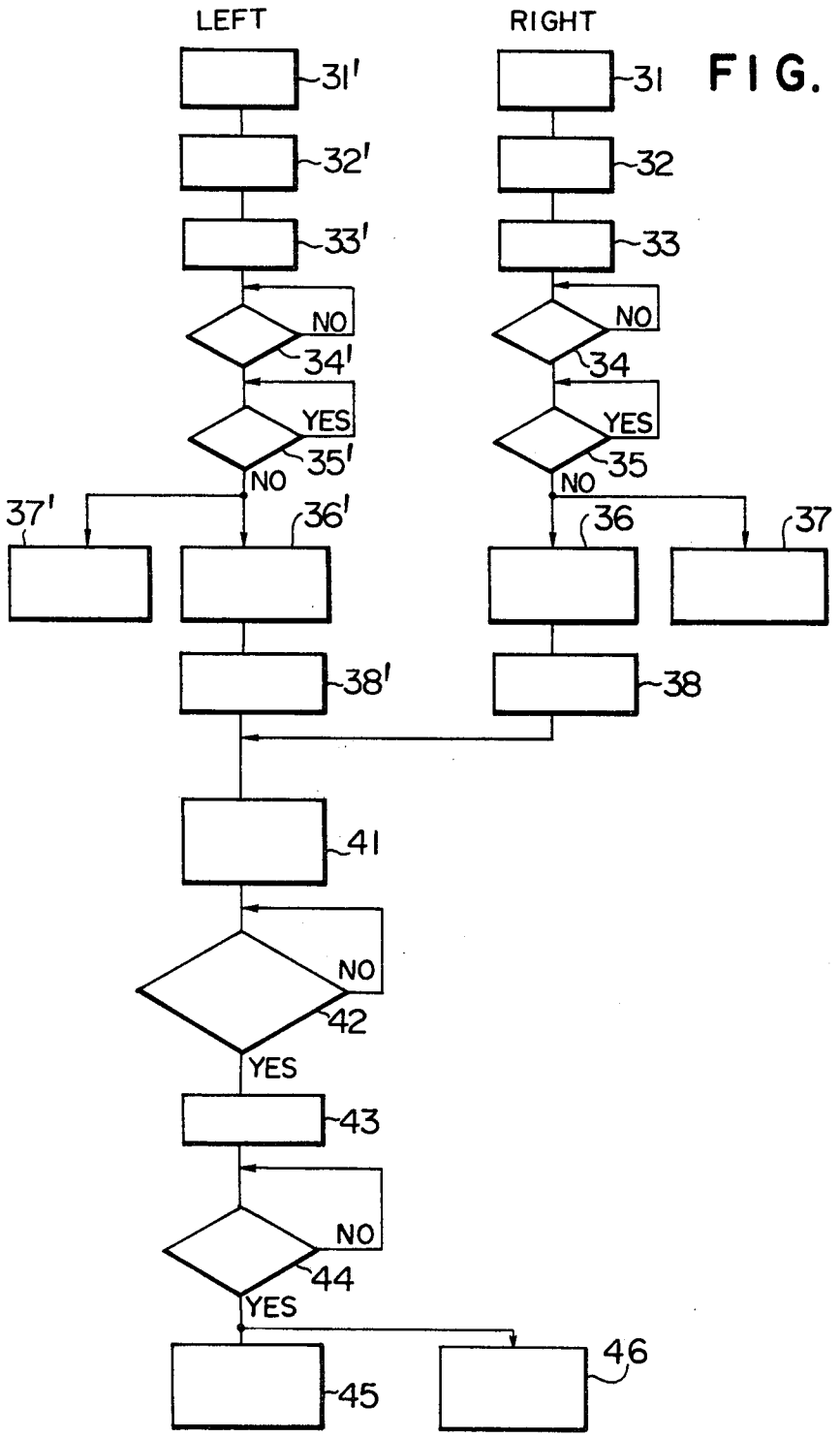
FIG. 4 is a flow chart showing a sequence of operations for the control system.

Referring to FIG. 4 showing a flow chart, there is shown a sequence of operations for the control system as mentioned above. In FIG. 4, the righthand (lefthand) side of the flow chart corresponds to the control console provided at the righthand (lefthand) side. Since the functions of the blocks at both sides are substantially identical, the blocks at the lefthand side are generally indicated by numerals the same as those of the righthand side, but having primes.

Numeral 31 indicates the operation of "Key On"; 32 "Discharge Number Conversion"; 33 "Discharge Number Register"; 34 "Discharge Key On?"; 35 "Under Discharge?"; 36 "Shift of Number from Number Register to Discharge Register"; 37 "Drive of Indicator Plates"; and 38 "Storage of Being under Discharge", respectively. Moreover, numeral 41 indicates the operation of "Count for Discharged Cash"; 42 "Indicator Plates Protruded during Opposite Side Discharge?"; 43 "Discharge of Cash"; 44 "Reception of Cash?"; 45 "Reset of Storage Being Discharged"; and 46 "Reset of Drive of Indicator Plates", respectively.

With reference to FIGS. 3 and 4, operations of the control system in the sequence of the flow chart will be explained diagramatically.

When the data on the kinds of coins and bills and the amount of money are put in the CPU 4*b* from the input device 4*a* by means of the signal $S_1$ through the operation of keys [31], the data is displayed on the display device 4*c* inaccordance with the signal $S_4$ and stored in the memory 4*d* in accordance with the signal $S_5$. At the same time, in the CPU 4*b* the data is subjected to a calculation for discharge number conversion [32].

The data on discharge number thus converted is put in the number register of the CPU 4*b* [33].

When the discharge key is operated [34-ON], the discharge request signal $S_7$ is issued from the CPU 4*b* to the CPU 11 through the signal $S_2$.

In case where the discharge request signal $S_7$ is issued from one control console earlier than the other control console, the request permission signal $S_9$ is returned to one control console. Insofar as the signal $S_9$ is not returned, the cash discharge apparatus is deemed to in the process of discharge and, therefore, the control console which has not received the signal $S_9$ is caused to assume a dwell condition [35-YES].

On the contrary, in case where the signal $S_9$ is returned [35-NO], the discharge data (discharge number data) is sent to the CPU 11 from the CPU 4*b* and stored in the discharge register of the CPU 11 [36]. As a result, the CPU 11 stores the fact that cash is being discharged [38].

At the same time, the signals $S_{13R}$ or $S_{13L}$ for driving the indicator plates are issued [37].

The CPU 11 which has received the data on discharge number issues the signals $S_{11}$ to the bill discharge machine and/or the coin discharge machine and monitors the count data signals $S_{12}$. When the number content of the signals $S_{11}$ becomes equal to the data on discharge number, the signals 11 are inhibited and the counting is completed [41].

After confirmation that the indicator plates are protruded is made [42-YES], cash is transferred to the money discharge exits [43]. When the sensors provided in the money discharge exits detect that the cash in the money discharge exits has been taken out [44-YES], the CPU 11 transmits the payment end signal $S_{10}$ to the corresponding CPU to reset the condition that cash is being discharged [45]. At the same time, the reset signal $S_{14R}$ or $S_{14L}$ is issued to cause the indicator plates to return to their initial positions [46].

The CPU of the control console which has received the payment end signal $S_{10}$ stops the output of the interlock signal $S_3$ so as to make the operations of the next cycle possible.

In the meantime, the CPU 11 which has issued the payment end signal $S_{10}$ is now ready for reception of the discharge request signal $S_7$. As a result, the CPU 11 returns the request permission signal $S_9$ back to the CPU of the other control console in response to the discharge request signal $S_7$ fed from the CPU of the other control console [35-NO].

With use of the control system thus far described, the following description is made in connection with the case in which the control system is set in the manner shown in FIG. 1 and the clerks on the opposite sides alternately use the cash discharge apparatus 1. If the clerk seated at the right side desk 5 operates his control console 4 on his desk, the indicator plates 15 are protruded forward from the lefthand slits 9L and 10L in response to the discharge of cash. As a result, the lefthand side clerk can be prevented from erroneously taking out the cash from the exits 1 and 3.

If, on the contrary, the lefthand side clerk operates his control console 4', the indicator plates 15 are protruded forward from the righthand side slits 9R and 10R so that the righthand side clerk can be prevented from erroneously taking out the cash.

What is claimed is:

1. A discharge side indicator device for use with a cash discharge apparatus which comprises a bill discharge machine and a coin discharge machine located thereon, comprising;

two pairs of indicator plates, one pair of which is disposed on the bill discharge machine at the opposite sides of the money discharge exit thereof, and the other pair of which is disposed on the coin discharge machine at the opposite sides of the money discharge exits thereof, said indicator plates being movable into and out of the body of said bill discharge machine and coin discharge machine, drive means for driving said indicator plates only at one side, when energized, to be protruded forward from the sides of said money discharge exits, and control means for controlling the energization of said drive means, whereby an indication is given that it is permissible to take cash out from only the side of said money discharge exits opposite to the side on which said indicator plates are protruded.

2. A device as set forth in claim 1 wherein said drive means comprises solenoids and gears driven by said solenoids so as to drive said indicator plates.

* * * * *